United States Patent [19]

Wahle

[11] 4,037,608

[45] July 26, 1977

[54] METHOD AND APPARATUS FOR PRODUCING CIGARETTES WITH DENSE ENDS

[75] Inventor: Günter Wahle, Reinbek, Germany

[73] Assignee: Hauni-Werke Körber & Co., KG, Hamburg, Germany

[21] Appl. No.: 609,151

[22] Filed: Aug. 29, 1975

[30] Foreign Application Priority Data

Sept. 11, 1974 Germany ..... 2443551

[51] Int. Cl.[2] ..... A24B 7/14; A24C 5/18

[52] U.S. Cl. ..... 131/21 B; 131/81 R; 131/84 C

[58] Field of Search ..... 131/21 R, 21 B, 21 D, 131/84 R, 84 C, 63, 65

[56] References Cited

U.S. PATENT DOCUMENTS

| | | | |
|---|---|---|---|
| 3,368,674 | 2/1968 | Koeppe | 73/81 X |
| 3,504,679 | 4/1970 | Lowman | 131/84 C X |
| 3,604,429 | 9/1971 | Witt | 131/21 B |
| 3,604,430 | 9/1971 | Norwich | 131/21 B |
| 3,608,562 | 9/1971 | Gomann | 131/84 C X |
| 3,738,376 | 6/1973 | Labbe et al. | 131/21 B |
| 3,742,795 | 7/1973 | Lipcon et al. | 131/21 B |

*Primary Examiner*—Stephen C. Pellegrino

*Attorney, Agent, or Firm*—Peter K. Kontler; John Kurucz

[57] ABSTRACT

Cigarettes with dense ends are produced by converting a continuous tobacco stream into a rod-like filler wherein spaced-apart portions contain more tobacco than the parts therebetween. The conversion involves removal of surplus tobacco from the stream in two stages during the first of which the stream is equalized to form an equalized stream of constant height and during the second of which the equalized stream is trimmed immediately following mechanical compacting of those portions of the equalized stream which correspond to spaced-apart portions of the filler. The trimming step involves removal of tobacco from non-compacted parts of the equalized stream. The quantity of tobacco in spaced-apart portions of the filler is monitored (either prior or subsequent to conversion of the filler and a web of wrapping material into plain cigarettes), and the equalizing stage of the tobacco removing step is regulated in dependency on the extent of deviation of monitored quantities from a predetermined quantity. The trimming stage of the tobacco removing step can be regulated in dependency on measurements of the quantity of tobacco in non-compacted parts of the filler.

19 Claims, 5 Drawing Figures

METHOD AND APPARATUS FOR PRODUCING CIGARETTES WITH DENSE ENDS

BACKGROUND OF THE INVENTION

The present invention relates to manufacture of filter mouthpieces, cigarettes, cigars, cigarillos or analogous rod-shaped smokers' products, and more particularly to improvements in a method and apparatus for making rod-shaped smokers' products (hereinafter called cigarettes for short) wherein the density of one or both ends of the rod-like smoke-filtering or tobacco filler exceeds the density of the major portion of the filler. Still more particularly, the invention relates to improvements in a method and apparatus for making plain or filter cigarettes with dense ends in such a way that the density of one or both ends invariably equals or closely approximates an optimum density.

The manufacturers of cigarettes prefer machines which turn out plain or filtered cigarettes wherein one or both ends of the tobacco filler contain more tobacco than the major portion of the filler. Such cigarettes are favored by consumers because tobacco shreds are less likely to escape at the ends during removal from a pack or another type of container. The escaping shreds are likely to contaminate the container, the pocket, the handbag, the floor or the furniture. Moreover, improperly filled ends of plain or filter cigarettes are likely to go up in flames when the cigarette is lighted. Still further, tobacco shreds escaping at the ends of cigarettes are likely to contaminate the packing machine. As a rule, it suffices to densify that end of a filter cigarette which is remote from the filter mouthpiece. On the other hand, and if a densification is to take place, it is preferred to densify both ends of a plain cigarette because it is equally annoying (and often even more annoying) if tobacco shreds escape at that end which is placed into the mouth.

In accordance with presently prevailing practice, cigarettes with dense ends are produced by forming a continuous tobacco stream which contains a surplus of tobacco and by thereupon trimming the stream in such a way that the portions which are to constitute dense ends contain more tobacco than the remaining portions of the resulting filler. The filler is thereupon wrapped into a continuous web of cigarette paper and the resulting rod is severed across or adjacent to the portions containing more tobacco to yield discrete cigarettes of unit length or multiple unit length.

It is already known (refer to German Offenlegungsschrift No. 2,011,933) to measure the quantity of tobacco in those portions of the filler which are to constitute dense ends of cigarettes and to utilize the results of measurements for regulation of the trimming action. A serious drawback of the just described proposal is that any adjustment in the rate of removal of tobacco in those portions which are to constitute dense ends of cigarettes necessarily entail substantial adjustments in the rate of removal of tobacco shreds from the other (major) portions of the tobacco stream. This can result in consumption of excessive quantities of tobacco and/or in unnecessary comminuting of tobacco shreds; such comminuting invariably takes place during trimming as well as when the surplus which has been removed from the stream is fed back into the distributor of a cigarette rod making machine.

SUMMARY OF THE INVENTION

An object of the invention is to provide a novel and improved method of making cigarettes or analogous rod-shaped smokers' products with dense ends wherein the quantity of fibrous material in the dense ends is invariably within a desired optimum range and wherein such uniformity of dense ends can be achieved by resorting to relatively simple and reliable apparatus.

Another object of the invention is to provide a method according to which the quanatity of fibrous material in dense ends of cigarettes or analogous rod-shaped articles can be varied practically instantaneously subsequent to detection of unsatisfactory dense ends.

A further object of the invention is to provide a method according to which the quantity of fibrous material in the major (undensified) parts of dense-end cigarettes can be regulated independently of regulation of quantities of fibrous material in the dense ends.

An additional object of the invention is to provide a method according to which the quantity of material in dense ends of cigarettes or like can be varied in dependency on a plurality of parameters including deviation of the quantities in dense ends from a predetermined range of satisfactory quantities as well as standard deviations of such quantity from an optimum quantity within the predetermined range.

Still another object of the invention is to provide a novel and improved apparatus for making cigarettes or analogous rod-shaped smokers' products with dense ends.

A further object of the invention is to provide an apparatus which can automatically regulate the quantity of fibrous material in non-densified portions or parts of rod-like fillers of cigarettes or the like independently of the regulation of quantity of fibrous material in dense ends, or vice versa.

Another object of the invention is to provide the apparatus with novel and improved means for removing fibrous material from a continuous stream of fibrous material which is to be converted into a rod-like filler ready to be draped into a web of wrapping material to form a wrapped filler which can be subdivided into sections (e.g., plain cigarettes) of desired length.

A further object of the invention is to provide novel and improved means for controlling and adjusting the operation of tobacco removing means in a cigarette rod making machine.

One feature of the invention resides in the provision of a method of making cigarettes or analogous smokers' products wherein an elongated rod-like filler of tobacco, synthetic plastic tobacco smoke filtering filaments or other suitable fibrous material is surrounded by a tubular wrapper consisting of cigarette paper, imitation cork or the like and the filler has at least one dense end. The method comprises the steps of forming a continuous stream consisting of fibrous material and containing material in excess of that which is required in the filler, removing material from the stream to convert the latter into a continuous rod-like filler wherein spaced-apart portions contain more material than the filler parts between such portions, monitoring the quantity of material in the spaced-apart portions, and varying the amounts of material which are removed from the spaced-apart portions independently or irrespective of the quantity of material in other filler parts when the monitored quantities deviate from a predetermined quantity (such predetermined quantity preferably includes a range of acceptable quantities including an optimum quantity and a plurality of additional quantities exceeding or less than the optimum quantity).

The method may further comprise the steps of draping a web of wrapping material around the continuous filler so that the web forms a tubular wrapper around the continuous filler of the resulting wrapped filler (e.g., a continuous cigarette rod), and severing the wrapped filler at predetermined intervals so that the wrapped filler yields sections of preselected length (such sections may constitute plain cigarettes of unit length). The severing step includes severing the wrapped filler in the region of spaced-apart portions which contain more fibrous material (e.g., the wrapped filler can be severed across or adjacent to such spaced-apart portions) so that each section has at least one dense end. The monitoring step may include transporting the sections sideways and measuring the quantity of fibrous material in the dense ends of the sections, i.e., in the dense ends of plain cigarettes or in the dense ends of filter cigarettes which are obtained by assembling plain cigarettes with filter mouthpieces. The measuring step may include monitoring the density of dense ends of discrete sections, for example, by resorting to a beta ray detector or to a capacitive density measuring device.

The method may further comprise the steps of conveying the stream and the continuous filler lengthwise, draping a web of wrapping material around the continuous filler so that the web forms a tubular wrapper of the resulting wrapped filler, and severing the wrapped filler at predetermined intervals subsequent to the monitoring step so that the wrapped filler yields sections of preselected length. The severing step includes severing the wrapped filler in the region of its spaced-apart portions so that each section has at least one dense end. In other words, the monitoring step may be carried out subsequent or prior to subdividing the wrapped filler into sections of selected length.

The monitoring step may comprise measuring the quantity of fibrous material in a plurality of successive spaced-apart portions of the filler (prior or subsequent to severing of the wrapped filler), and the varying step then comprises changing the amounts of material which are removed from the spaced-apart portions when the average quantity of fibrous material in the aforementioned plurality of successive spaced-apart portions deviates from the predetermined quantity.

As mentioned above, the predetermined quantity preferably comprises a range of quantities including an optimum quantity and a plurality of additional acceptable quantities exceeding and/or less than the optimum quantity. The method may further comprise the steps of measuring the standard deviation of satisfactory monitored quantities (i.e., of those quantities which are within the aforementioned range of acceptable quantities) from the optimum quantity and varying the amounts of material which are removed from the spaced-apart portions as a function of the extent of standard deviation. If the varying step is performed in dependency on one or more characteristics (e.g., intensity) of electric signals which are being produced on monitoring the quantities of material in the spaced-apart portions, the signals can be modified by signals which are indicative of the extent of standard deviation of monitored satisfactory quantites from the optimum quantity.

The method may further comprise the steps of conveying the spaced-apart portions along a predetermined path, counting the total number ot spaced-apart portions which move along a predetermined portion of the path within a predetermined interval of time (such total number will always equal a given number if the spaced-apart portions are conveyed at a constant speed), and determining the sum total of those spaced-apart portions within the total number wherein the monitored quantity of fibrous material deviates from the predetermined quantity or range of quantities. The varying step then comprises changing the amounts of material which are being removed from spaced-apart portions of the stream as a function of the number of spaced-apart portions forming the sum.

More specifically, the removing step may comprise equalizing the stream (which is being conveyed lengthwise along a predetermined path) in a first portion of the path so as to convert the stream into an equalized or trimmed stream of constant or nearly constant height, compacting those portions of the equalized stream which correspond to spaced-apart portions of the continuous filler whereby the height of compacted portions is less than the constant height and is preferably the same irrespective of the height of the equalized stream, an immediately trimming the equalized and compacted stream (before the normally elastic material in compacted portions of the equalized stream can expand) in a second portion of the aforementioned path to remove at least some material from the uncompacted portions of the equalized stream and to thus convert the equalized stream into a continuous filler. The varying step comprises changing the equalizing step to thereby change the height of the equalized stream.

The just mentioned material removing step may further comprise measuring the quantity of material in continuous filler parts between the spaced-apart portions which latter contain more fibrous material, and changing the trimming step to remove more or less material from the equalized stream when the measured quantity deviates from a preselected quantity. The compacting of material in the equalized stream may (but need not always) be so pronounced that the trimming of the equalized and compacted stream does not result in removal of any material from compacted portions of the equalized stream.

The noval features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
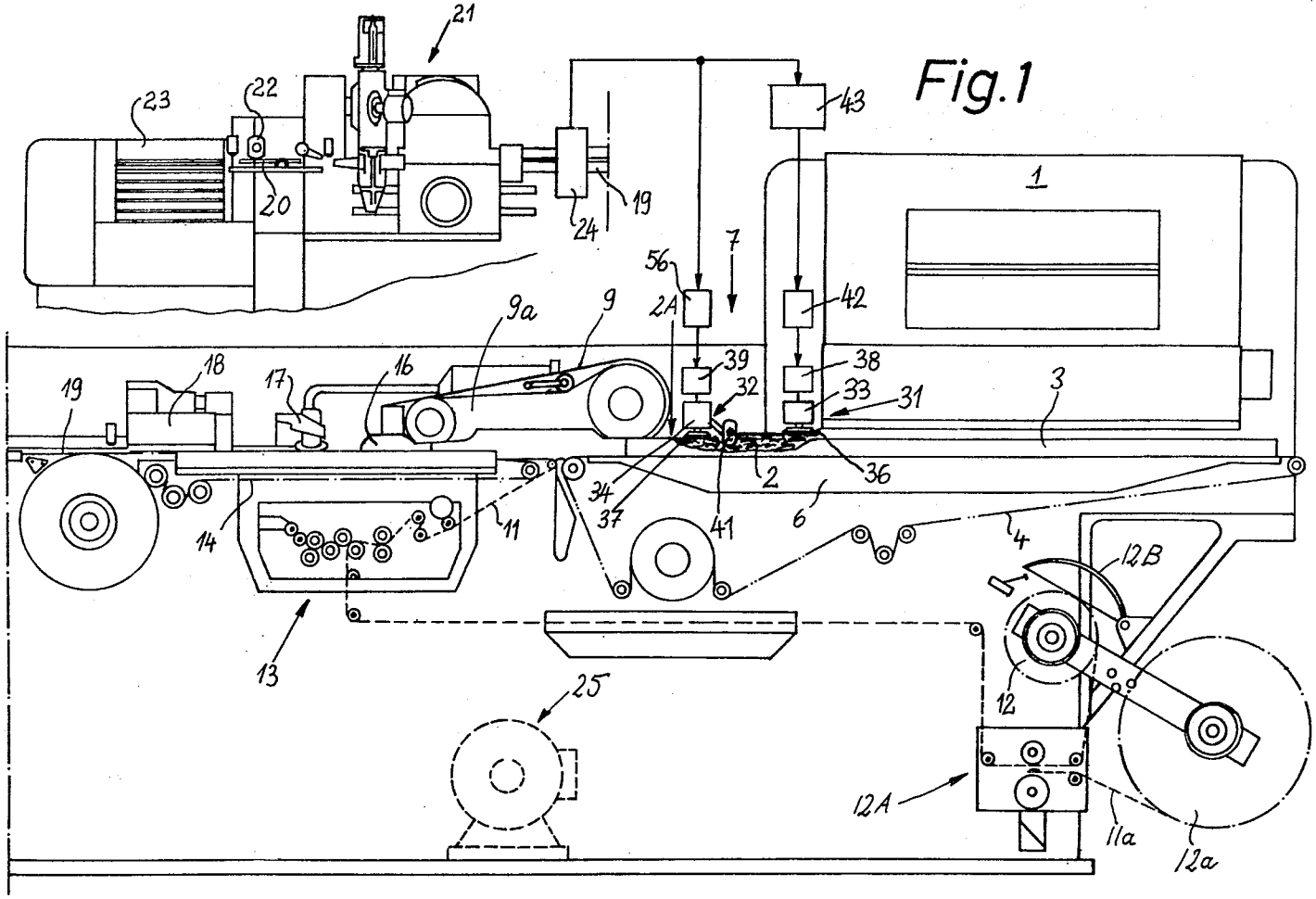
FIG. 1 is a schematic elevational view of an apparatus which embodies one form of the invention and includes a cigarette rod making machine as well as novel and improved means for controlling the removal of tobacco from a continuous tobacco stream to thereby convert the stream into a continuous rod-like filler having spaced-apart portions containing more tobacco than the parts between such portions.

The cigarette rod making machine of FIG. 1 has a distributor 1 which discharges tobacco shreds into an elongated narrow horizontal channel 3. The bottom wall of the channel 3 is the upper reach of an endless band conveyor 4 which consists of foraminous material. The upper reach of the conveyor 4 travels above the perforated top wall of an elongated suction chamber 6 so that the shreds of the growing narrow tobacco stream adhere to the conveyor 4 during travel toward the first of two trimming or equalizing devices 31, 32 forming part of an adjustable surplus removing unit 7. The fully grown tobacco stream 2 is converted into a rod-like filler 2A (best shown in FIG. 2) which is transferred onto a continuous web 11 of cigarette paper which is being withdrawn from a roll 12 and passes through a splicing device 12A and thereupon through an imprinting device 13. The device 13 serves to provide spaced-apart portions of the web 11 with indicia representing the brand name of the cigarette, the name and/or the trademark of the manufacturer and/or others. The web 11 is transported longitudinally by the upper reach of a garniture 14. The means for assiting in the transfer of tobacco from the conveyor 4 onto the web 11 on the garniture 14 comprises an endless conveyor 9 which may consist of foraminous metallic material and the lower reach of which travels below a stationary suction chamber 9*a*. The removal of surplus tobacco which must be carried out in order to convert the stream 2 into filler 2A is effected by the unit 7.

The diameter of the roll 12 is monitored by a detector 12B which actuates the splicing device 12A when the supply of web 11 is nearly exhausted whereby the device 12A attaches the web 11 to the leader of a fresh web 11*a* forming a roll 12*a*. The device 12A thereupon severs the web 11 behind the splice and the roll 12*a* is moved into the range of the detector 12B. The remnant of the roll 12 is replaced with a fresh roll and the leader of the web on such fresh roll is threaded into the splicing device 12A.

The web 11 on the upper reach of the garniture 14 moves the filler 2A through a wrapping mechanism 16 which drapes the web 11 around the filler in such a way that one marginal portion of the web 11 extends tangentially from the filler. Such marginal portion is then coated with adhesive by the wheel-shaped applicator of a paster 17 before the thus coated marginal portion is folded over the marginal portion to form therewith a seam extending longitudinally of the resulting cigarette rod 19. The seam can be heated by a sealer 18 to promote the setting of adhesive. The rod 19 is severed at desired intervals by the orbiting knife or knives of a severing device 21 (called cutoff) so that it yields a single file of plain cigarettes 20 of unit length or multiple unit length. Successive cigarettes 20 of the file are accelerated by a rotary cam 22 and enter successive flutes of a drum-shaped conveyor 23 serving to convert the single file into one or more rows wherein the cigarettes 80 move sideways. The conveyor 23 transports plain cigarettes 20 to a filter cigarette making machine, to a tray filling apparatus, to storage, directly to a packing machine or to another distination.

The reference character 25 denotes the main prime mover (e.g., a variable-speed motor) of the cigarette rod making machine. The density of successive increments of the filler 2A in the tubular wrapper of the cigarette rod 19 is monitored by a density measuring device or detector 24 which produces signals serving to adjust the tobacco removing unit 7. The detector 24 may comprise a source of beta rays at one side and an ionization chamber at the other side of the path for the rod 19 between the sealer 18 and cutoff 21.

Figure 2:
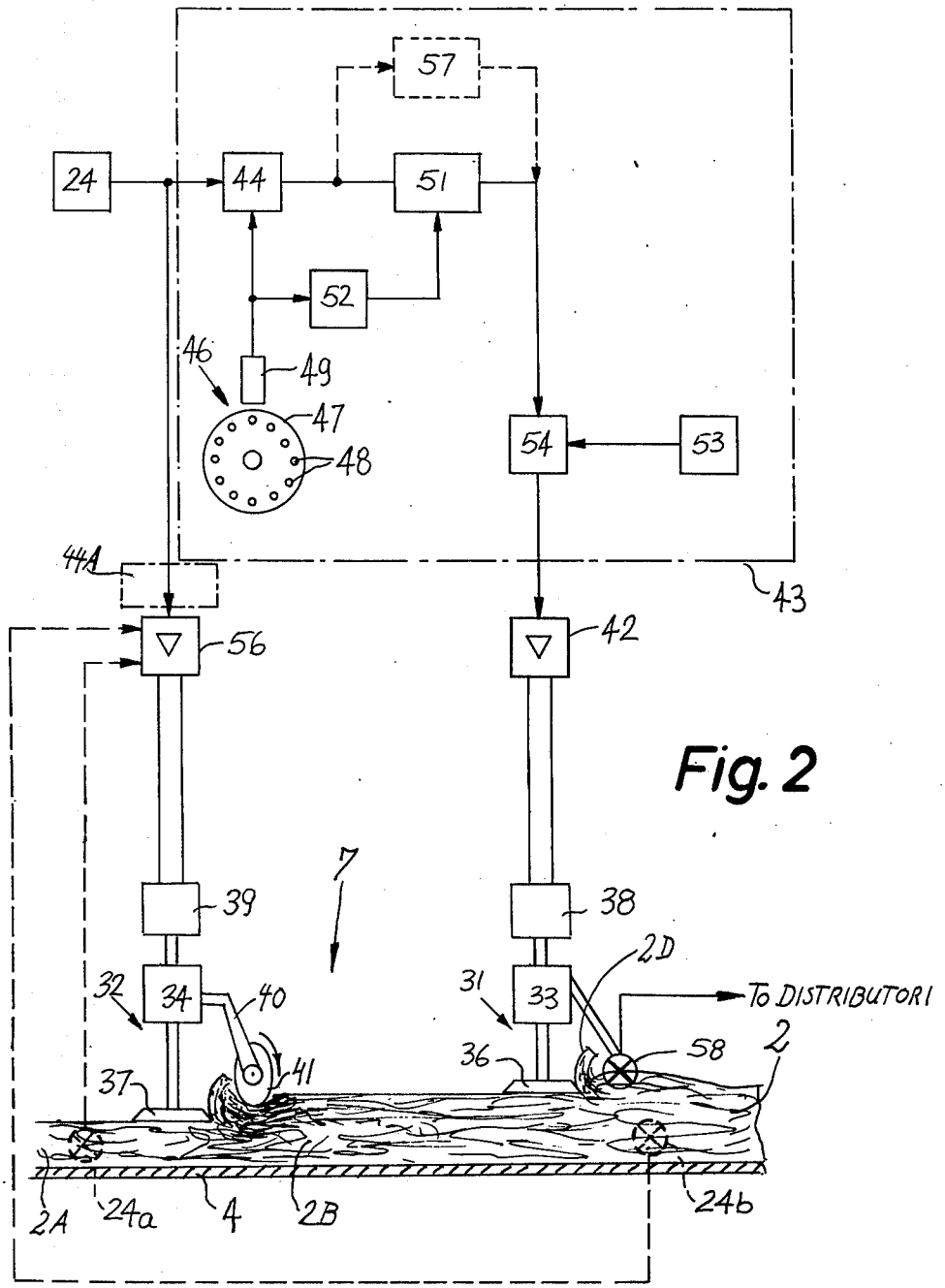
FIG. 2 is an enlarged view of a detail in FIG. 1, showing the tobacco removing unit and the control means therefor.

FIG. 2 shows the construction of the removing unit 7 and the adjusting means therefor. Certain elements of the adjusting means for the removing unit 7 are also shown in FIG. 1. The trimming or equalizing devices 31, 32 of the removing unit 7 respectively comprise rotary tobacco removing elements or cutters 36, 37 which can be moved nearer to or further away from the upper reach of the conveyor 4. Such movements are effected by servomotors 38, 39. The means for rotating the cutters 36, 37 comprises two discrete motors 33, 34 which can share the movements of the respective cutters toward or away from the conveyor 4.

The distance between the upper reach of the conveyor 4 and the plane of the cutter 36 exceeds the distance between such upper reach of conveyor 4 and the plane of the cutter 37. Thus, the once-trimmed or equalized stream 2B between the devices 31, 32 has a constant height but still carries some surplus tobacco, and such surplus is removed by the cutter 37 to convert the equalized stream 2B of constant height into filler 2A. The housing of the motor 34 for the cutter 37 carries a bracket or an analogous support 40 for a driven mechanical compacting or condensing device 41 having one or more protuberances or lobes which reduce the height of spaced-apart portions of the equalized stream 2B immediately ahead of the cutter 37. The condensing device 41 is a disk-shaped or roller-shaped cam which is driven by the prime mover 25 in synchronism with other moving parts of the cigarette rod making machine. The number of lobes and/or the speed of the compacting device 41 is selected in such a way that the knife or knives of the cutoff 21 invariably sever the filler 2A of the rod 19 across or adjacent to the densified portions or that such knife or knives alternately sever (a) across or adjacent to densified portions and (b) across non-densified (uncompacted) portions of the filler. As a rule, the filler 2A will be severed only across densified portions if the plain cigarettes 20 constitute the ultimate products (i.e., each plain cigarette will have two dense ends). The filler 2A will be severed adjacent to densified portions or alternately (a) across densified portions and (b) across uncompacted portions if the cigarettes 20 are to be assembled with filter mouthpieces to constitute filter cigarettes; this is due to the fact that it normally suffices to densify that end portion of the tobacco filler in a filter cigarette which is remote from the mouthpiece.

The servomotor 38 for the cutter 36 of the trimming device 31 receives voltage signals from an amplifier 42 which is connected with one output of a control circuit 43. The latter further comprises a second output which is connected to an amplifier 56 for the servomotor 39 and an input which is connected with the output of the detector 24. The intensity and polarity of voltage signals from the amplifiers 42, 56 respectively determine the extent and direction of movement of cutters 36, 37 relative to the upper reach of the conveyor 4. As stated above, the detector 24 preferably (but not necessarily) comprises a source of corpuscular radiation and an ionization chamber; such types of detectors have found widespread acceptance in the tobacco industry for measurement of the density of minute increments of rod-like tobacco fillers or tobacco streams. Nevertheless a capacitive density measuring device can be used with equal advantage.

The control circuit 43 comprises means (e.g., a suitable electronic gate circuit 44) which permits passage of signals indicating the density of (quantity of material in) those portions of the filler 2A which are to constitute dense ends but intercepts or suppresses all other signals. The gate circuit 44 is connected with the output of a pulse generator or synchronizer 46 which transmits pulses at a frequency corresponding to that at which the rod 19 is being severed by the cutoff 21. The gate circuit 44 allows a signal to pass therethrough when it receives a pulse from the synchronizer 46. The latter comprises a disk 47 which is driven by the prime mover 25 in synchronism with the input shaft of the cutoff 21 and carries an annulus of magnets 48 travelling seriatim past a proximity detector switch 49 which is connected to the gate circuit 44 and transmits a pulse while it is being bypassed by the nearest magnet 48. The output of the gate circuit 44 then allows the signal from the detector 24 to reach the corresponding input of an integrating circuit 51, and such signal is indicative of the density of that portion of the filler 2A in the rod 19 which is to constitute a dense end. In its simplest form, the integrating circuit 51 may constitute an operational amplifier which totals a predetermined number of signals and transmits a signal representing the sum of such signals in response to a signal from a counter 52 which is connected with the switch 49 of the synchronizer 46. The signal from the counter 52 resets the integrating circuit 41 to zero. The signal which is transmitted by the integrating circuit 51 reaches one input of a junction 54 which compares the signal with a signal of desired intensity (supplied by an adjustable potentiometer 53 or another suitable rated value selector). When the intensity of signal from 51 deviates from the intensity of signal which is transmitted by 53, the junction 54 transmits a signal which causes the amplifier 42 to move the cutter 36 nearer to or away from the conveyor 4 through the medium of the servomotor 38. As mentioned above, the intensity of signal from 43 to 38 determines the extent and the polarity of such signal determines the direction of movement of the cutter 36 with respect to the conveyor 4. When the portions of the the filler 2A which are to constitute dense ends contain less tobacco than desired (i.e., as indicated by intensity of signal from the potentiometer 53), the cutter 36 is moved away from the upper reach of the conveyor 4, and vice versa. If the cutter 36 is lifted, the quantity of tobacco shreds which are removed from the stream 2 by the trimming device 31 is reduced.

The signal which is transmitted from the integrating circuit 51 to the junction 54 is indicative of the average density of a selected number of densified portions of the filler 2A, i.e., of such number of densified portions of the filler as is selected by the setting of the counter 52. The latter is preferably adjustable. For example, the counter 52 can be set to allow the integrating circuit 51 to totalize or average a series of signals whose number equals a fixed number or the number of densified filler portions which travel past the detector 24 per unit of time. As a rule, the latter number is also a fixed number since the machine of FIG. 1 is assumed to normallyoperate at a constant speed.

It will be seen that the first trimming device 31 removes some of the surplus of tobacco shreds at a rate which is dependent on the measurement of quantity of tobacco in those portions of the filler 2A which are densified by the compacting device 41.

If the integrating circuit 51 is to receive signals at less frequent intervals, i.e., because only one end of each plain cigarette 20 is densified for reasons explaind above or because it is considered satisfactory to transmit a signal to circuit 51 in response to travel of each n-th densified filler portion past the detector 24 (wherein *n* is a whole number exceeding one), the disk 47 of the synchronizer 46 is replaced with a disk having a different number of magnets 48. It is also within the purview o the invention to omit the circuit 51 and counter 52 and to connect the output of the circuit 44 directly to the junction 54. However, it is normally preferred and advisable to totalize two or more signals so that the signal reaching the junction 53 is a sum of two or more signals. This insures that unavoidable sporadic inaccurate measurements of one or more densified filler portions cannot entail in improper adjustment of the cutter 36 relative to the conveyor 4.

The equalized stream 2B advances toward the second trimming device 32 which removes less tobacco (or no tobacco at all) in those regions which are to constitute dense ends of the cigarettes 20. Such regions are compressed by the lobes of the compacting device 41, and the latter is placed sufficiently close to the cutter 37 to insure that the compacted or condensed regions cannot expand due to innate elasticity of tobacco shreds prior to travel past the trimming device 32. The quantity of tobacco in densified portions of the equalized stream 2B is dependent on the distance between the plane of the cutter 36 and the upper reach of the conveyor 4, i.e., on adjustment of trimming device 31 in response to signals from the detector 24.

The quantity of tobacco in non-densified portions or parts of the filler 2A is determined by the position of the cutter 37 with respect to the upper reach of the conveyor 4. Such position is adjustable in respone to signals from the detector 24 which is directly connected with the input of the amplifier 56. If desired or necessary, the connection between the detector 24 and the amplifier 56 may include a second gate circuit 44A (indicated by phantom lines) serving to suppress or block those signals which can pass through the gate circuit 44 but to allow other signals to reach the amplifier 56. This insures that the position of the cutter 37 relative to the conveyor 4 will not change when the detector 24 monitors densifie portions of the filler 2A.Such position is adjustable in respone to signals from the detector 24 which is directly connected with the input of the amplifier 56. If desired or necessary, the connection between the detector 24 and the amplifier 56 may include a second gate circuit 44A (indicated by phantom lines) serving to suppress or block those signals which can pass through the gate circuit 44 but to allow other signals to reach the amplifier 56. This insures that the position of the cutter 37 relative to the conveyor 4 will not change when the detector 24 monitors densified portions of the filler 2A.

It will be readily appreciated that the wrapping mechanism 16 of FIG. 1 drapes the web 11 around the filler 2A in such a way that densified portions of the filler do not cause bulging of adjacent overlying portions of the wrapper of the rod 19. In other words, the cross-sectional area of the rod 19 is constant in spite of the fact that the filler 2A therein contains portions having greater quantities of tobacco and alternating with portions having lesser quantities of tabacco.

In accordance with the heretofore described operation of the control circuit 43, the servomotor 38 will adjust the position of the cutter 36 in dependency on the determined median or average intensity of a series of signals reaching the integrating circuit 51 via gate circuit 44 whenever the latter receives a pulse from the switch 46. However, it is often equally desirable (or also desirable) to adjust the position of the cutter 36 in dependency on other factors, especially in dependency on standard (upward or downward) deviation of density of monitored densified filler portions from an optimum density. Such standard deviation ($\sigma$) can be expressed by the equation $$\sigma = \sqrt{(\epsilon\,(xi - \bar{x})^2/\eta)}$$

wherein $xi$ are the intensities of individual signals, $x$ the average intensity of a given number of signals (counter 52), and $n$ the number of such signals. If the standard deviation increases, the average quantity of tobacco shreds in the dense ends must be increased in order to insure that the number of unavoidable rejects which will be produced in a machine turning out cigarettes at the rate of up to and in excess of 4000 per minute will not exceed a given maximum permissible number, i.e., that the customary testing unit for dense ends will not eject an excessive number of cigarettes due to insufficient density of their ends.

The average density of dense ends can be reduced if the standard deviation decreases; this is desirable because it results in savings of tobacco.

The standard deviation can be determined by a transducer 57 (shown in FIG. 2) by broken lines because optional) which is connected in parallel with the integrating circuit 51 and receives signals simultaneously with the integrating circuit 51. The signal at the output of the transducer 57 then influences or modifies the signal from the output of the integrating circuit 51 to the junction 54. Transducers which can be used in the control circuit 43 of FIG. 2 are disclosed, for example, in U.S. Pat. No. 3,515,860. The arrangement is preferably such that the intensity of signal from 51 to 54 increases when the standard deviation (as detected by the transducer 57) increases, and vice versa. Fluctuations of tobacco quantities in dense ends of cigarettes may be stochastic fluctuations. This renders it desirable to measure a succession of compacted portions prior to adjustment of the cutter 36.

It is further within the purview of the invention to utilize a discrete detector for generation of signals which are transmitted to the servomotor 39 for adjustment of the cutter 37 in the second trimming device 32. For example, the amplifier 56 need not be connected with the detector 24; instead, its input can be connected to a discrete detector **24*a* located immediately downstream of the trimming device 32 or to a discrete detector 24*b* located immediately upstream of the trimming device 31. In each instance, the discrete detector is preferably placed close to the trimming device 32. The detector 24*a* and/or 24*b* may constitute a beta ray detector similar or analogous to the detector 24, a capacitive density measuring device or any other suitable means for measuring the density of tobacco in successive increments of the stream 2 of 2B or filler 2A. If the amplifier 56 is connected to the detector 24*a*, the connection preferably includes the gate circuit 44A**.

The cigarette rod making machine of FIGS. 1 and 2 may further comprise an additional measuring or monitoring device 58 which is shown in FIG. 2 as being rigidly connected with the housing of the motor 33 of the cutter 36 and serves to measure the height of the tobacco stream 2, i.e., the quantity of tobacco in the mass of shreds moving with the upper reach of the conveyor 4. The output of the device 58 is connected with the controls of the distributor 1 and preferably regulates the operation of distributor 1 in such a way that the quantity of surplus (shown in FIG. 2 at 2D) removed by the cutter 36 is constant or fluctuates within a rather narrow range, irrespective of the distance between the plane of the cutter 36 and the conveyor 4.

The aforedescribed determination of average density of a plurality of successive densified filler portions (especially if combined with determination of standard deviation) can be achieved by resorting to a relatively complex circuit even though the individual components (which may be of the analog or digital type) are readily available on the market. The cost of circuitry shown in and described in connection with FIG. 2 can be reduced considerably if some of the components shown in FIG. 2 (such as the counter 52 and transducer 57) are used to simultaneously perform one or more additional functions. Thus, it is now customary to monitor and/or regulate the operation and/or output of modern high-speed cigarette rod making machines and other machines for the processing of tobacco and filter material by resorting to counters, computers and analogous monitoring means. Such monitoring means can be used to perform their primary function (e.g., regulation and/or monitoring of the output and/or operation of tobacco processing or like machines) as well as to constitute component parts of the circuit of FIG. 2.

Figure 3:
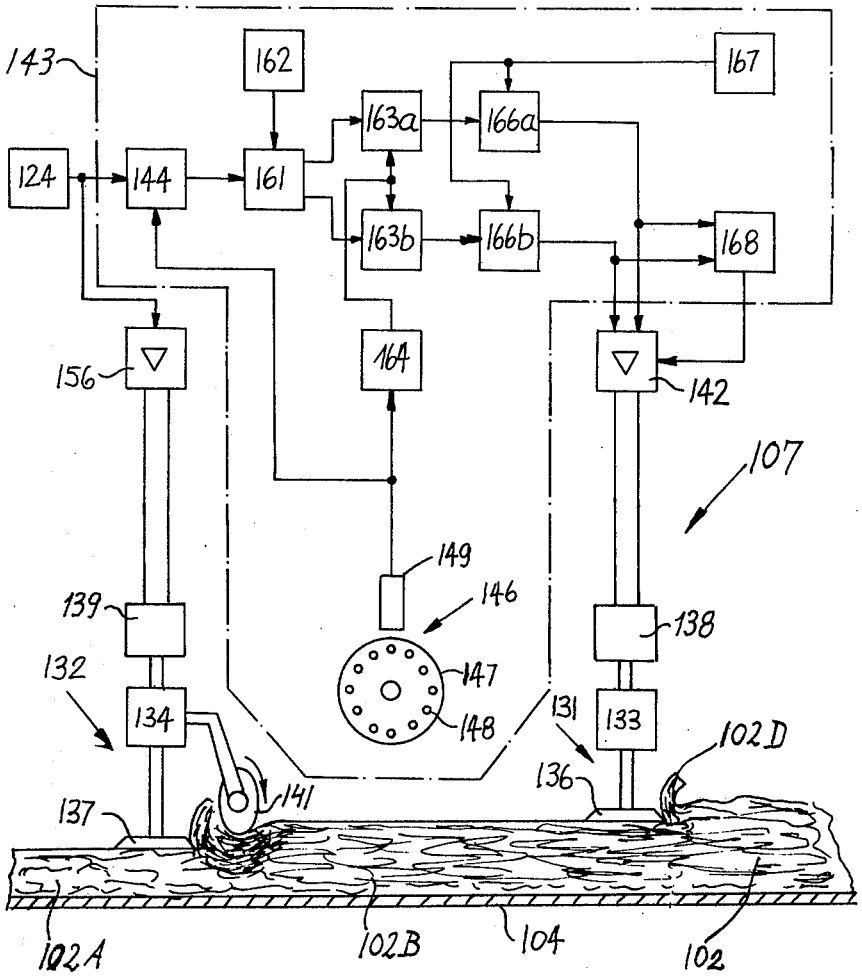
FIG. 3 shows the tobacco removng unit of FIG. 2 and modified control means.

FIG. 3 shows a relatively simple control circuit 143 which constitutes a modification of the circuit 43 of FIG. 2. All such components which are identical with or analogous to those shown in FIG. 2 are denoted by similar reference characters plus 100.

The detector 124 transmits signals which are indicative of the quantity of tobacco in successive increments of the rod-like filler 102A. The gate circuit 144 of the control circuit 143 permits those signals which are indicative of the quantity of tobacco shreds in densified portions of the filler 102A to reach the corresponding input of a junction 161. The timing of signal transmission from detector 124 to junction 161 via gate circuit 144 is regulated by a synchronizer 146 corresponding to the synchronizer 46 of FIG. 2. The junction 161 compares the signals from 144 with those transmitted by a preferably adjustable rated value selector 162 (e.g., a potentiometer) whereby the reference signals from 162 indicate the desired density of compacted filler portions. When the intensity of signal from 144 to 161 indicates that the measured densified portion of the filler 102A does not contain enough tobacco, the junction 161 transmits a signal to a first error or defect counter **163*a***.

If the intensity of signal from 144 to 161 is indicative of a densified filler portion which contains an excessive quantity of tobacco shreds, the signal from 161 is transmitted to a second error or defect counter 163*b*. When the gate circuit 144 has transmitted a preselected number of signals (which may be indicative of satisfactory, insufficiently dense or overly dense compacted portions of the filler 102A), the counters 163*a*, 163*b* are reset to zero by a preferably adjustable counter 164 corresponding generally to the counter 52 of FIG. 2. The input of the counter 164 is connected with the switch 149 of the synchronizer 146. When the counters 163*a*, 163*b* receive erasing signals from the counter 164, they transmit signals to additional junctions 166*a*, 166*b* which are further connected with a rated value selector 167. Each signal which the counter 163*a* transmits to the junction 166*a* is indicative of the total number of defective compacted portions (namely, compacted portions containing less than the desired quantity of tobacco shreds) within a predetermined number (e.g., 4000) of successively tested densified portions. Analogously, the signal from 163*b* to 166*b* is indicative of the total number of defective densified portions containing excessive quantities of tobacco shreds within the same predetermined number of successively tested densified end portions. A comparison of signals which are transmitted to junctions 166*a*, 166*b* (from the counters 163*a*, 163*b* on the one hand and from the rated value selector 167 on the other hand) determines whether the amplifier 142 will receive a signal of first or second polarity, i.e., whether the cutter 136 of the trimming device 131 will be moved toward or away from the adjacent reach of the conveyor 104. The intensity of signal from 166*a* or 166*b* to amplifier 142 and thence to the servometer 138 will determine the extent of movement of the cutter 136 relative to the conveyor 104.

If the adjustment which is carried out when the junctions 166*a*, 166*b* respectively receive signals from the counters 163*a*, 163*b* does not result in sufficient adjustment of the cutter 136, the same procedure is repeated when the counter 164 transmits the next signal, i.e., after the next interval of monitoring a predetermined number of successive densified portions of filler 102A by the detector 124. The adjustment is repeated as often as necessary in order to insure that the total number of unsatisfactory (overly compact or insufficiently compacted) densified portions of the filler 102A within a given interval does not exceed that number which is selected by setting of the selector 167.

If the number of overly compacted as well as the number of insufficiently densified portions of the filler 102A within a monitoring interval exceeds the number determined by setting of the selector 167, the servomotor 138 is incapable of effecting an appropriate adjustment of the distance between the plane of the cutter 136 and the adjacent reach of the conveyor 104 (because the position of cutter 136 would have to be changed in both directions). The junctions 166*a*, 166*b* then transmit signals to an alarm device 168 which can produce a visible, audible and/or otherwise detectable signal. Such signal indicates to the attendant(s) that the cigarette rod making machine requires an adjustment beyond that which can be carried out by the servomotor 138. When the junctions 166*a*, 166*b* transmit signals to the alarm device 168, they preferably cease to transmit signal to the amplifier 142 so that the position of the cutter 136 remains unchanged.

It is clear that the control circuit 143 of FIG. 3 can be simplified if the manufacture merely desires to insure that the quantity of tobacco shreds in densified portions of the filler 102A should not drop below a predetermined minimum or should not exceed a predetermined maximum permissible quantity. The circuit 143 is then operative even if the parts 163*b*, 166*b* or 163*a*, 166*a* are omitted.

The connection between the detector 124 and the amplifier 156 for the servomotor 139 of FIG. 3 may include a gate circuit corresponding to the gate circuit 44A of FIG. 2.

The machine of FIG. 1 (with adjustable tobacco removing unit 7 or 107 of the type shown in FIG. 2 or 3) exhibits the advantage that the density of those portions of the tobacco filler which are to constitute dense ends of cigarettes can be detected practically immediately downstream of the second trimming station, i.e., even before the wrapped filler 2A or 102A is subdivided into sections of unit length of multiple unit length. However, the density of one or both ends of a plain cigarette or the density of the free end of a filter cigarette might change during further processing. This is especially likely to happen when plain cigarettes are united with filter mouthpieces because the attachment of filter mouthpieces normally involves repeated manipulation (e.g., changes in orientation) of plain cigarettes prior to, during and subsequent to assembly with filter mouthpieces. Even plain cigarettes which are not intended to be united with filter mouthpieces are likely to lose tobacco shreds at their ends, for example, when such cigarettes are loaded into chargers or trays and transported to the magazine of a packing machine for introduction into soft or hard packs. In other words, it can occur that the density of ends of plain or filter cigarettes which reach the consumer is unsatisfactory in spite of the fact that the density was monitored and regulated in a manner as described in connection with FIG. 2 or 3. Therefore, it is often desirable to monitor the density of cigarette ends as late as possible, i.e., close to the packing machine to thus insure that the removing unit for surplus tobacco will be adjusted in a manner to guarantee that the density of the ends of cigarettes which reach the consumer is more likely to be acceptable than if the density of the ends were monitored at a locus which is relatively close to the cutter or cutters of the trimming device(s). This can be achieved by monitoring the density of the ends of finished products, i.e., of one or both ends of discrete plain cigarettes or the exposed tobacco-containing ends of filter cigarettes (which latter may be of unit length or double unit length at the time the monitoring operation is being performed).

Figure 4:
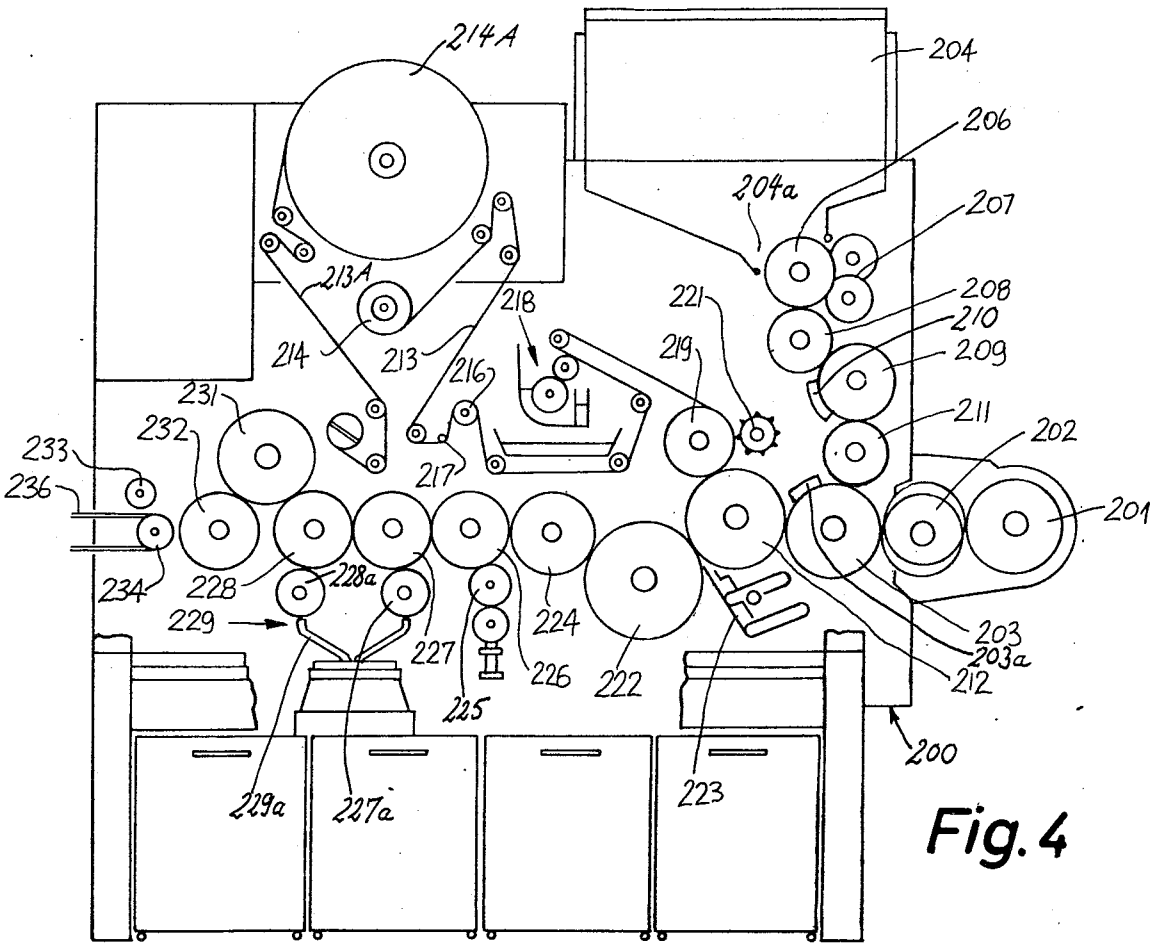
FIG. 4 is a schematic elevational view of a portion of a second apparatus which, in addition to a cigarette rod making machine, further comprises a filter cigarette making machine and means for monitoring the quantity of tobacco in dense ends of filtered cigarettes.

FIG. 4 shows a filter cigarette making or tipping machine which can assemble plain cigarettes with filter mouthpieces of double unit length to form filter cigarettes of double unit length and which thereupon converts each filter cigarette of double unit length into two filter cigarettes of unit length. The machine of FIG. 4 comprises a frame 200 which supports a drum-shaped row forming conveyor 201 corresponding to the row forming conveyor 23 of FIG. 1. The conveyor 201 converts a single file of plain cigarettes of unit length into two rows in such a way that the cigarettes of one row are staggered with respect to the cigarettes of the other row, as considered in the circumferential direction of the conveyor 201. This can be achieved by regulating the introduction of plain cigarettes into successive flutes of the conveyor 201 in such a way that the first, third, fifth, etc. cigarettes of the single file issuing from the maker (e.g., a machine of the type shown in FIG. 1) are caused to move close to the remote axial end of the conveyor 201 and that cigarettes entering the second, fourth, sixth, etc. flutes are caused to come to a halt close to the other axial end of the conveyor 201, i.e., close to that axial end which is nearer to the accelerating cam 22 of FIG. 1.

The conveyor 201 delivers the plain cigarettes of one row to the flutes of one and the plain cigarettes of the other row to the other of two rotary drum-shaped aligning conveyors 202 which are driven at different speeds and/or transport the respective plain cigarettes through different distances to thereby insure that each flute of a rotary drum-shaped assembly conveyor 203 receives two coaxial plain cigarettes of unit length whereby the two plain cigarettes are spaced apart from each other to form a gap having a length (as considered in the axial direction of the assembly conveyor 203) which at least equals but preferably exceeds the length of a filter mouthpiece of double unit length.

The top portion of the frame 200 supports a magazine or hopper 204 which contains a supply of parallel filter rod sections of 6 times unit length. The outlet 204*a* of the magazine 204 is adjacent to the upper portion of a rotary drum-shaped severing conveyor 206 having equally spaced flutes machined into its peripheral surface and serving to transport a single row of filter rod sections of six times unit length past two rotary disk-shaped knives 207 which sever the sections so that each thereof yields a group of three coaxial filter rod sections or mouthpieces of double unit length. The conveyor 206 delivers the groups to three drum-shaped staggering conveyors 208 each of which receives one mouthpiece of each group. The conveyors 208 (only one shown in FIG. 4) transport filter mouthpieces through different distances and/or at different speeds so that each group of three coaxial mouthpieces is converted into a series of mouthpieces which are staggered with respect to each other, as considered in the circumferential direction of the illustrated conveyor 208. The conveyors 208 deliver the thus staggered mouthpieces of double unit length into successive flutes of a rotary drum-shaped shuffling conveyor 209 which cooperates with suitable cam means 210 to shift some or all of the mouthpieces axially so that such mouthpieces from a single row wherein each preceding mouthpiece is in exact register with the next-following mouthpieces. Successive mouthpieces of the thus obtained row are introduced into successive flutes of a rotary drum-shaped accelerating conveyor 211 which inserts one mouthpiece of double unit length into each flute of the assembly conveyor 203 in such a way that the mouthpiece is located between the respective pair of coaxial plain cigarettes and forms therewith a group of three coaxial rod-shaped components ready to be converted into a filter cigarette of double unit length. The assembly conveyor 203 moves successive groups past suitable stationary cam means 203*a* serving to move one or both plain cigarettes axially toward the other plain cigarette in the respective flute so that the inner ends of the cigarettes abut against the respective ends of the associated mouthpiece of double unit length. The thus condensed or shortened groups are transferred into successive flutes of a rotary drum-shaped transfer conveyor 212.

The frame 200 further supports a bobbin or reel 214 consisting of a web 213 of convoluted cigarette paper, imitation cork or the like. The web 213 is being withdrawn by a driven advancing roll 216 and is caused to move past a so-called breaker 217 which imparts to the web a tendency to curl and to thereby promote the coiling of uniting bands (to be obtained upon severing of the leader of the web 213) around the mouthpieces of groups which are ready to be converted into filter cigarettes of double unit length. One side of the web 213 is coated with a suitable adhesive which is applied by the roller of a paster 218 and the leader of the web 213 is attracted to the periphery of a rotary suction drum 219 cooperating with a rotary knife 221 to sever the leader at regular intervals and to thus form a succession of adhesive-coated uniting bands. Each uniting band is attached to a group on the transfer conveyor 212 in such a way that the band adheres to the respective mouthpiece of double unit length as well as to the adjacent inner end portions of the respective plain cigarettes of unit length. The groups (each of which carries a uniting band) are thereupon transferred onto a rotary drum-shaped wrapping conveyor 222 cooperating with a rolling unit 223 to convert the uniting bands into tubes which surround the respective mouthpieces and the adjacent inner end portions of the respective plain cigarettes of unit length. This completes the conversion of plain cigarettes, filter mouthpieces and uniting bands into a row of filter cigarettes of double unit length.

Successive filter cigarettes of double unit length are transferred into the flutes of a rotary drum-shaped drying or heating conveyor 224 which promotes the setting of adhesive bonding the coiled uniting bands to the adjacent rod-shaped components of the respective filter cigarettes of double unit length, and the filter cigarettes are thereupon transferred onto a rotary drum-shaped severing conveyor 226 cooperating with a rotary disk-shaped knife 225 which severs each coiled uniting band and the respective filter mouthpiece midway between its ends to thus convert each filter cigarette of double unit length into two filter cigarettes of unit length. Each filter cigarette of unit length is composed of a plain cigarette of unit length, of a mouthpiece of unit length, and of one half of a coiled uniting band.

The conveyors 224 or 226 may form part of a testing device which monitors the condition of wrappers of filter cigarettes of double unit length and transmits signals to a suitable ejector serving to segregate defective filter cigarettes from satisfactory articles. Satisfactory filter cigarettes of unit length are delivered to a turn-around device 229 of the type disclosed in U.S. Pat. No. 3,583,546 to Koop. This device has a first rotary drum-shaped conveyor 227 which receives pairs of coaxial filter cigarettes of unit length from the severing conveyor 226, a second rotary drum-shaped conveyor 228 which receives one filter cigarette of each pair from the conveyor 227 and which has twice as many flutes as the conveyor 227, a third rotary drum-shaped conveyor 227*a* which receives the other filter cigarette of each pair from the conveyor 227, a turn-around unit 229*a* which inverts successive filter cigarettes supplied by conveyor 227a end-for-end, and a fourth rotary drum-shaped conveyor 228*a* which receives successive inverted cigarettes from the unit 229*a* and delivers them into empty flutes of the conveyor 228 so that the latter assembles a single row of filter cigarettes of unit length wherein all mouthpieces face in the same direction.

The exposed dense ends of plain cigarettes forming part of successive filter cigarettes on the conveyor 228 are monitored by a density detector 231 which produces signals serving to effect segregation of filter cigarettes having unsatisfactory dense ends (or no dense ends at all) from satisfactory filter cigarettes. Such segregation takes place on a rotary drum-shaped transfer conveyor 232 which transports filter cigarettes with satisfactory dense ends onto the upper reach of an endless belt conveyor 236. Successive filter cigarettes which travel above the right-hand pulley 234 for the conveyor 236 are braked by a roller 233. The conveyor 236 can deliver satisfactory filter cigarettes of unit length to a packing machine, not shown.

It will be noted that the detector monitors the density of adjacent tobacco-containing ends of filter cigarettes of unit length while such cigarettes are being transported sideways.

FIG. 4 further shows a fresh bobbin or reel 214A consisting of web 213A whose leader is automatically or semiautomatically spliced to the web 213 when the supply of web 213 on reel 214 is nearly exhausted. The splicing device may be similar or analogous to the device 12A of FIG. 1.

Figure 5:
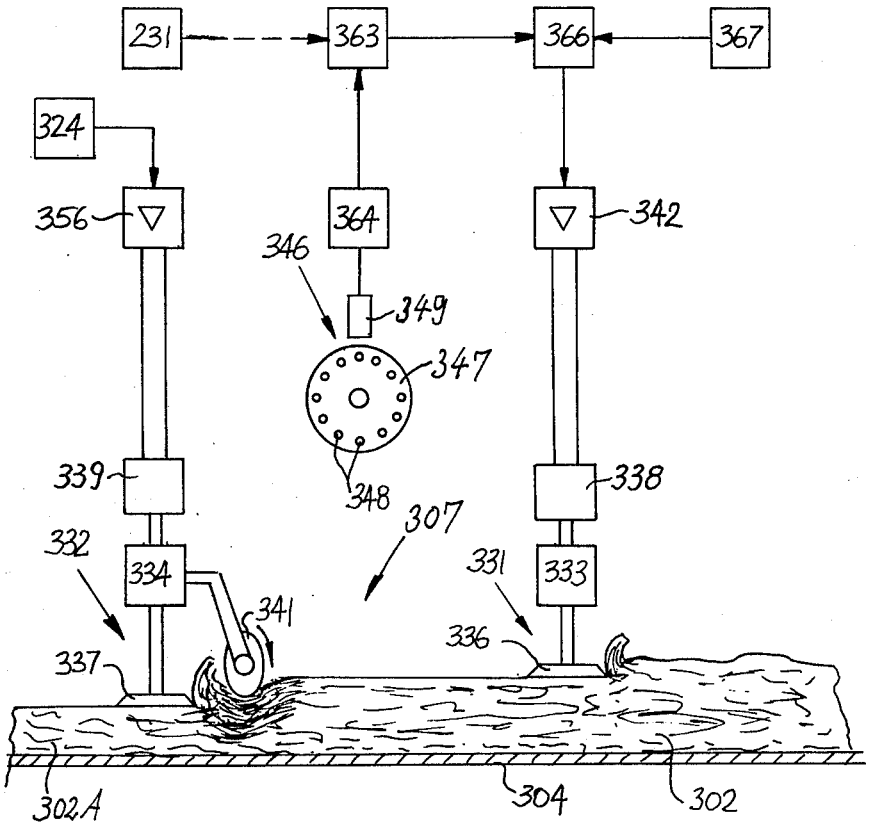
FIG. 5 is a view similar to that of FIGS. 2 or 3, showing the tobacco removing unit of the cigarette rod making machine which is associated with the filter cigarette making machine of FIG. 4 and control means for regulating the operation of the removing unit in response to signals from the monitoring means of FIG. 4.

The detector 231 may form part of a cigarette end testing unit of the type disclosed in commonly owned U.S. Pat. No. 3,368,674. If the detector 231 determines that the density of tobacco-containing ends of filter cigarettes of unit length advancing toward the conveyor 232 is insufficient, the testing unit produces a signal which is transmitted to the preferably pneumatic ejector mechanism adjacent to the transfer conveyor 232 so that defective cigarettes are segregated from satisfactory cigarettes before the satisfactory cigarettes reach the conveyor 236. The just mentioned signals are further transmitted to a counter 363 of defective cigarettes which is shown in FIG. 5. The counter 363 is further connected with a preferably adjustable counter 364 which counts the total number of cigarettes produced within a selected interval of time. The counter 364 receives pulses from a pulse generator or synchronizer 346 having a disk 347 with magnets 348 and a proximity detector switch 349. The disk 347 rotates in synchronism with the main shaft of the filter cigarette making machine of FIG. 4 so that the number of pulses transmitted from 349 to 364 corresponds to the number of filter cigarettes produced within the aforementioned interval of time. When the counter 364 receives a certain number of pulses, it transmits a signal to the counter 363 to reset the latter to zero as well as to cause the counter 363 to transmit a signal which is indicative of the total number of defective cigarettes within the selected interval of time. As a rule, the prime mover 25 of the cigarette rod making machine will also drive the moving parts of the associated filter cigarette making machine.

Signals from the counter 363 are transmitted to a junction 366 which compares such signals with a signal transmitted by a selector 267 for maximum permissible number of defective filter cigarettes per unit of time. If the intensities of the two signals reaching the junction 366 are different, i.e., if the counted number of defective filter cigarettes is excessive, the junction 366 transmits a signal of corresponding polarity and intensity to the amplifier 342 which is analogous to the amplifier 42 of FIG. 2 and serves to actuate the servomotor 338 for the cutter 336 of the trimming device 331 in the cigarette rod making machine. The cutter 336 is rotated by the motor 333. The second trimming device 332 of the tobacco removing unit 307 shown in FIG. 5 comprises a cutter 337, a motor 334 which rotates the cutter 337 and a servomotor 339 which can be actuated by an amplifier 356 receiving signals from a density measuring device 324, e.g., a beta radiation detector such as the detector **24, 24*a* or 24*b* of FIG. 2.**

When the servomotor 338 adjusts the distance between the upper reach of the conveyor 304 and the plane of the cutter 336 because the number of defective filter cigarettes in the machine of FIG. 4 is excessive, the cutter 336 is moved away from the conveyor 304 so that the trimming device 331 removes less tobacco from the stream 302. Therefore, the densifying action of the compacting device 341 is more pronounced.

The arrangement may be such that the cutter 336 is adjusted incrementally. If a first incremental displacement in a direction away from the conveyor 304 does not suffice, the junction 366 transmits a further signal (after elapse of the interval determined by setting of the counter 364) whereby the servomotor 338 causes the cutter 336 to rise (as viewed in FIG. 5) by a further increment. The same procedure can be repeated as often as necessary until the signal (or the absence of signal) from the junction 366 indicates that the density of filter cigarette ends (as determined by the unit including the detector 231) is acceptable.

The concentration between the detector 324 and amplifier 356 may include a gate circuit which performs a function similar to that of the gate circuit 44 except that it allows signals to pass from the detector 324 to the amplifier 356 during intervals when the detector 324 monitors the non-densified portions of the filler 302A.

The circuit of FIG. 5 can be modified in a number of ways without departing from the spirit of the invention. For example, the testing unit including the detector 231 can transmit signals whose intensity (or another characteristic) is proportional to quantities of tobacco in the tobacco-containing ends of successive filter cigarettes of unit length. Such signals can be processed and utilized in a manner as described in connection with FIG. 3. Thus, each signal is compared with a signal whose intensity is indicative of a satisfactory or optimum density and, when the deviation between the intensities of the two signals is excessive, the resulting signal is transmitted to a counter. The first trimming device 331 is then adjustable in such a way that the cutter 336 can move nearer to or further away from the upper reach of the conveyor 304, depending upon whether the deviation between the intensities of the two signals is positive or negative, i.e., whether the ends of filter cigarettes are too dense or too soft.

If it is desired to measure the density of ends of plain cigarettes, such measurement may be carried out immediately prior to introduction of plain cigarettes into a packing machine, e.g., after removal of cigarettes from customary chargers or trays. The manner in which the measurements are then used to influence the quantity of tobacco shreds in densified portions of the filler is preferably the same as described in connection with FIG. 5. Thus, and if the measurements are carried out upon finished smokers' products, the locus of measurement is preferably as close to the packing station as possible in order to make sure that plain or filter cigarettes are less likely to lose tobacco at the ends prior to introduction into packs or other types of containers.

An important advantage of the improved method and apparatus is that the density of cigarette ends can be measured independently of the density of non-densified portions of the cigarettes, and that the results of measurements can be used to influence the quantity of tobacco in the cigarette ends without, however, influencing the quantity of tobacco shreds in the non-densified major portions of fillers. The measurements may be carried out prior to subdivision of a continuous filler into sections of unit or multiple unit length or upon completion of conversion of the filler and wrapping material into discrete rod-shaped smokers' products.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. A method of making cigarettes or analogous smokers' wherin an elongated rod-like filler of fibrous material is surrounded by a tubular wrapper and the filler has at least one dense end, comprising the steps of forming a continuous stream consisting of said fibrous material and containing material in excess of that which is required in the filler; removing material from said stream to convert the latter into a continuous rod-like filler wherein spaced-apart portions contain more material than the filler parts between such portions; monitoring the quantity of material in said spaced-apart portions; and varying the amounts of material which are removed from those portions of the stream which correspond to said spaced-apart portions independently of the quantity of material in said filler parts when the monitored quantities deviate from a predetermined quantity.

2. A method as defined in claim 1, further comprising the steps of draping a web of wrapping material around said continuous filler so that the web forms a tubular wrapper of the resulting wrapped filler, and severing the wrapped filler at predetermined intervals so that the wrapped filler yields sections of preselected length, including severing the wrapped filler in the region of said spaced-apart portions so that each of said sections, has at least one dense end, said monitoring step including transporting said sections sideways and measuring the quantity of material in dense ends of said sections.

3. A method as defined in claim 2, wherein said measuring step includes monitoring the density of dense ends of said sections.

4. a method as defined in claim 1, further comprising the steps of conveying said stream and said continuous filler lengthwise, draping the web of wrapping material around said continuous filler so that the web forms a tubular wrapper of the resulting wrapped filler, and severing said wrapped filler at predetermined intervals subsequent to said monitoring step so that the wrapped filler yields sections of preselected length, including severing the wrapped filler in the region of said spaced-apart portions so that each of said sections has at least one dense end.

5. A method as defined in claim 1, wherein said monitoring step comprises measuring the quantity of fibrous material in a plurality of successive spaced-apart portions, said varying step comprising changing the amounts of material which are removed from said spaced-apart portions when the average quantity of fibrous material in said plurality of successive spaced-apart portions deviates from said predtermined quantity.

6. A method as defined in claim 1, wherein said predetermined quantity comprises a range of quantities including an optimum quantity and a plurality of quantities exceeding and/or less than said optimum quantity, and further comprising the steps of measuring the standard deviation of satisfactory monitored quantities within said range from said optimum quantity and varying the amounts of material which are removed from said spaced-apart portions as a function of the extent of said standard deviation.

7. A method as defined in claim 1, further comprising the steps of conveying said spaced-apart portions along a predetermined path, counting the total number of spaced-apart portions which move along a predetermined portion of said path within a predetermined interval of time, and determining the sum total of those spaced-apart portions within said total number wherein the monitored quantity of material deviates from said predetermined quantity, said varying step comprising changing the amounts of material which are removed from said spaced-apart portion as a function of the number of spaced-apart portions forming said sum.

8. A method as defined in claim 1, further compising the step of conveying said stream lengthwise along the predetermined path, said removing step comprising equalizing the stream in a first portion of said path so as to convert the stream into an equalized stream of constant height, compacting those portions of the equalized stream which correspond to said spaced-apart portions of the continuous filler whereby the height of compacted portions is less than said constant height, and immediately trimming the equalized and compacted stream in a second portion of said path to remove at least some material at least from the uncompacted portions of said equalized stream and to thus convert said equalized stream into said continuous filler, said varying said step comprising varying said equalizing step to thereby change the height of said equalized stream.

9. A method as defined in claim 8, further comprising the steps of measuring the quantity of material in said parts between said spaced-apart portions, and changing said trimming step to remove more or less material from the equalized stream when the measured quantity deviates from a preselected quantity.

10. Apparatus for making cigarettes or analogous smokers' products wherein an elongated rod-like filler of fibrous material is surrounded by a tubular wrapper and the filler has at least one dense end, comprising means for forming a continous stream consisting of said fibrous material and containing material in excess of that which is required in the filler; adjustable means for removing material from said stream so as to convert the latter into a continous rod-like filler wherein spaced-apart portions contain more material than the filler parts between such portions; means for monitoring the quanity of material in said spaced-apart portions; and control means operatively connected with said removing means and with said monitoring means and including means for adjusting said removing means when the monitored quantities deviate from a predetermined quantity so that the amounts of material which said removing means removes from the stream portions corresponding to said spaced-apart portions of the continuous filler are independent of the quantity of material in said parts of the filler.

11. Apparatus as defined in claim 10, further comprising means for converting said continuous filler into a continuous wrapped filler, means for subdividing the wrapped filler at predetermined intervals so that said wrapped filler yields a succession of discrete sections, and means for conveying said sections sideways, said subdividing means including a device for severing the wrapped filler in the region of said spaced-apart portions so that each of said sections has at least one dense end and said monitoring means comprising means for measuring the quantity of material in the dense ends of said sections while said sections move sideways.

12. Apparatus as defined in claim 11, wherein said measuring means comprising for monitoring the density of said ends of said sections.

13. Apparatus as defined in claim 10, further comprising means for conveying said continuous filler lengthwise along a predetermined path, said monitoring means including detector means adjacent to said path.

14. Apparatus as defined in claim 10, wherein said control means further comprises means for producing a first signal which is indicative of the average quantity of material in a plurality of successive spaced-apart portions, means for producing a second signal which is indicative of said predetermined quantity and means for comparing said first and second signals and for producing a third signal which is indicative of the difference between said first and second signals, said adjusting means being arranged to adjust said removing means in response to said third signal.

15. Apparatus as defined in claim 14, wherein said predetermined quantity comprises a range of quantities and a plurality of additional acceptable quantities exceeding and/or less than said optimum quantity, said control means further comprising means for producing a fourth signal which is indicative of standard deviation of monitored satisfactory quantities from said optimum quantity and for changing the intensity of said third signal in dependency on the intensity of said fourth signal.

16. Apparatus as defined in claim 10, further comprising means for conveying said spaced-apart portions along a predetermined path, said control means further comprising means for counting the total number of spaced-apart portions advancing along a predetermined portion of said path within a predetermined interval of time, means for determining the sum total of those spaced-apart portions within said total number wherein the quantity of material deviates from said predetermined quanity, means for comparing said sum with a predetermined number, and means for actuating said adjusting means to respectively effect the removal of less and more material from said stream when said sum respectively exceeds and is less than said predetermined number.

17. Apparatus as defined in claim 10, further comprising means for conveying said stream in a predetermined direction along a predetermined path, said removing means comprising an equalizing device adjacent to a first portion of said path and having first cutter means for equalizing said steam so that the height of the equalized stream is constant, means for compacting those portions of the equalized stream which correspond to said spaced-apart portions of the continuous filler whereby the height of compacted portions of the equalized stream is less than said constant height, and a trimming device adjacent to a second portion of said path immediately downstream of said compacting means and having second cutter means for removing material at least from the non-compacted portions of the equalized stream whereby the latter is converted into a continuous filler, said adjusting means including means for moving said first cutter means with respect to said conveying means to thereby change the height of said equalized stream.

18. Apparatus as defined in claim 17, wherein said control means further comprises means for measuring the quantity of material in said parts of the continuous filler and means for adjusting said second means relative to said conveying means when the measured quantity deviates from a predetermined quantity.

19. Apparatus as defined in claim 18, wherein said measuring means is said monitoring means.

* * * * *

UNITED STATES PATENT OFFICE

CERTIFICATE OF CORRECTION

Patent No. 4,037,608 Dated July 26, 1977

Inventor(s) Günter WAHLE

It is certified that error appears in the above-identified patent and that said Letters Patent are hereby corrected as shown below:

Foremost page, left-hand column, item [73], the comma should be deleted after "Co.".

Column 1, line 57, "adjustment" should be pluralized.

Column 2, line 22, --the-- should be inserted after "or".

Column 5, line 36, "assiting" should read --assisting--;
line 61, --other-- should be inserted after "the".

Column 8, line 16, "explaind" should read --explained--;
line 22, "o" should read --of--;
line 30, "in" should read --an--;
line 59, "densifie" should read --densified-- and "Such position is" should be deleted;
lines 60 through 68 should be deleted.

Column 9, lines 1 and 2 should be deleted;
line 43, "2)" should read --2--.

Column 11, line 34, "servometer" should read --servomotor--;
line 66, "signal" should be pluralized.

Column 12, line 2, "manufacture" should read --manufacturer--.

Column 16, line 24, "concentration" should read --connection--.

Claim 1, line 2, "wherin" should read --products wherein--.

Claim 4, line 1, "a" should read --A--;
line 3, "the" should read --a--.

Claim 8, line 2, "the" (second occurrence) should read --a--;
penultimate line, "said" (first occurrence) should be deleted.

Claim 10, line 12, "quanity" should read --quantity--.

Claim 14, line 2, "comprising" should read --comprises means--.

Claim 16, line 10, "quanity" should read --quantity--.

Claim 17, line 6, "steam" should read --stream--.

UNITED STATES PATENT OFFICE

CERTIFICATE OF CORRECTION

Patent No. 4,037,608 Dated July 26, 1977

Inventor(s) Günter WAHLE

It is certified that error appears in the above-identified patent and that said Letters Patent are hereby corrected as shown below:

Claim 18, line 4, --cutter--should be inserted after "second".

Signed and Sealed this

Ninth Day of May 1978

[SEAL]

Attest:

RUTH C. MASON
Attesting Officer

LUTRELLE F. PARKER
Acting Commissioner of Patents and Trademarks